US012584399B2

(12) United States Patent
Regler et al.

(10) Patent No.: US 12,584,399 B2
(45) Date of Patent: Mar. 24, 2026

(54) METHOD FOR CARRYING OUT A CONSTRUCTION MEASURE AND CONSTRUCTION DEVICE

(71) Applicant: BAUER Maschinen GmbH, Schrobenhausen (DE)

(72) Inventors: Hans Regler, Schrobenhausen (DE); Christian Hoyme, Rehau (DE); Jochen Maurer, Munich (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 366 days.

(21) Appl. No.: 18/245,832

(22) PCT Filed: Aug. 12, 2021

(86) PCT No.: PCT/EP2021/072509

§ 371 (c)(1),
(2) Date: Mar. 17, 2023

(87) PCT Pub. No.: WO2022/069104

PCT Pub. Date: Apr. 7, 2022

(65) Prior Publication Data

US 2024/0026768 A1 Jan. 25, 2024

(30) Foreign Application Priority Data

Oct. 1, 2020 (EP) ..... 20199644

(51) Int. Cl.

| | |
|---|---|
| ***E21B 44/00*** | (2006.01) |
| *E02D 7/00* | (2006.01) |
| *E02D 7/18* | (2006.01) |
| *E02D 9/00* | (2006.01) |
| *E02D 17/00* | (2006.01) |
| *E02F 9/26* | (2006.01) |

(52) U.S. Cl.

CPC ..... *E21B 44/00* (2013.01); *E02D 7/00* (2013.01); *E02D 7/18* (2013.01); *E02D 9/005* (2013.01); *E02D 17/00* (2013.01); *E02F 9/265* (2013.01)

(58) Field of Classification Search

CPC .. E21B 44/00; E02F 9/267; E02F 9/26; E02F 9/00; E02D 7/02

See application file for complete search history.

(56) References Cited

U.S. PATENT DOCUMENTS

| | | | | |
|---|---|---|---|---|
| 7,539,625 | B2 * | 5/2009 | Klumpen | G06Q 10/06312 705/7.22 |
| 2012/0316787 | A1 * | 12/2012 | Moran | E21B 44/00 702/9 |
| 2013/0080339 | A1 * | 3/2013 | Driesen | G06Q 10/00 705/301 |
| 2013/0292178 | A1 * | 11/2013 | Burress | G06F 17/18 175/50 |
| 2018/0012310 | A1 * | 1/2018 | Fox | G05B 19/045 |
| 2019/0390547 | A1 * | 12/2019 | Pietrzyk | E21B 44/00 |
| 2020/0149361 | A1 * | 5/2020 | Neuville | E21B 19/10 |
| 2021/0404292 | A1 * | 12/2021 | Jaakkola | E21B 41/00 |

FOREIGN PATENT DOCUMENTS

| | | |
|---|---|---|
| CN | 104 533 320 | 1/2017 |
| DE | 11 2013 005 546 T5 | 8/2015 |
| EP | 2 725 145 A2 | 4/2014 |
| WO | 2016/044371 A1 | 3/2016 |

OTHER PUBLICATIONS

International Search Report issued in PCT/EP2021/072509; mailed Nov. 23, 2021.
International Preliminary Report on Patentability (Chapter II) issued in PCT/EP2021/072509; completed Jan. 4, 2023.

* cited by examiner

*Primary Examiner* — Mong-Shune Chung
(74) *Attorney, Agent, or Firm* — Studebaker Brackett PLLC

(57) ABSTRACT

The invention relates to a method for carrying out a construction measure, in particular a foundation engineering measure, with a construction device, in particular with a foundation engineering machine, which has a plurality of actuation elements and sensors for recording operating states relating to the actuation elements, and with a computer unit, by which recorded parameter values of the sensors are received when carrying out the construction measure. According to the invention provision is made in that for a construction measure a number of different defined process steps are stored, in that from one defined process step to at least one subsequent defined process step a transition takes place as a result of at least one exit rule, wherein to each exit rule at least one characteristic parameter value of at least one sensor is assigned, and in that the recorded parameter values of the sensors are checked as to the exit rules and, if they occur, a transition from an associated defined process step to a subsequent defined process step is detected.

11 Claims, No Drawings

METHOD FOR CARRYING OUT A CONSTRUCTION MEASURE AND CONSTRUCTION DEVICE

The invention relates to a method for carrying out a construction measure, in particular a foundation engineering measure, with a construction device, in particular with a foundation engineering machine, which has a plurality of actuation elements and sensors for recording operating states relating to the actuation elements, and with a computer unit, by which recorded parameter values of the sensors are received when carrying out the construction measure, in accordance with the preamble of claim 1.

The invention further relates to a construction device, in particular a foundation engineering machine, with a plurality of actuation elements and sensors for recording operating states relating to the actuation elements and a computer unit for receiving values recorded by the sensors on the operating states, in accordance with the preamble of claim 10.

From WO 2016/044 371 A1 a system and a method for determining the productivity of a drilling project is known. On a drilling machine data are recorded during operation that relate to a plurality of method steps executed when carrying out the drilling measure. For individual method steps starting times and end times can be recorded automatically. A possible starting time of a method step is indicated to a machine operator and confirmed by him. With the starting time an electronic time stamp is generated so that a time span is recorded in total. Moreover, depending on the input of the operator the type of the method step can be identified so that a data output on the type and duration of a method step can take place.

From DE 11 2013 005 546 T5 a working machine and a method for measuring a working performance of a working machine can be taken. The working machine has an operation state detection unit for detecting an actuation of an actuation lever. By means of a time integration unit the time span of an actuation process can be recorded. By means of a determination unit a number of a series of excavation and loading work processes can be recorded and taken into consideration in the further evaluation of data.

In the hitherto existing logging of process operations when carrying out construction measures a manual identification and a confirmation of specific start or end states is required on the part of a machine operator. This makes a precise logging of construction measures more difficult and affects a reliable data evaluation.

The invention is based on the object to provide a method for carrying out a construction measure and a construction device which enable a particularly efficient and reliable evaluation of process steps when carrying out construction measures.

The object is achieved on the one hand by a method having the features of claim 1 and on the other hand by a construction device having the features of claim 10. Preferred embodiments of the invention are stated in the dependent claims.

The method according to the invention is characterized in that for a construction measure a number of different defined process steps are stored, in that from one defined process step to at least one subsequent defined process step a transition takes place as a result of at least one exit rule, wherein to each exit rule at least one characteristic parameter value of at least one sensor is assigned, and in that the recorded parameter values of the sensors are checked as to the exit rules and, if they occur, a transition from an associated defined process step to a subsequent defined process step is recognized.

A basic idea of the invention resides in the fact that in a computer unit a number of different defined process steps are stored for a construction measure, wherein for each of the defined process steps a transition as a result of at least one exit rule is stored. To each exit rule at least one characteristic parameter value of at least one sensor is assigned. Preferably, several parameter values of different sensors are stored, by which a transition from one process step to another process step is defined.

When carrying out a construction measure a stream of data can be generated by different sensors and actuation elements and forwarded to the computer unit. This stream of data is checked with regard to the stored exit rules as to whether a transition from one process step to a subsequent process step is present. The procedure takes place without confirmation of a machine operator or any other manual action.

The exit rule refers to a so-called event which represents a transition from one process step to a specific subsequent process or method step. The construction measure always begins with a first process step which itself does not necessarily have to be recorded. The exit rule defines, as it were, a door leading from one process step to a defined subsequent process step. For a process step several possible subsequent process steps can be provided, for which a defined exit or transition rule is stored in each case.

Assignment of the defined process steps to the recorded data can take place immediately by a computer unit of the construction device or at a later point in time using a separate computer unit. By way of a dynamic or modified definition of the exit rules a targeted analysis of large amounts of data and thereby a pinpoint analysis of complex construction measures can be carried out in particular at a later point in time.

The method according to the invention allows the definition of a dynamic list of process steps. A definition of individual process steps can be broadened, restricted or modified at any time prior to an evaluation. The list of the process steps can be carried out in particular after completion of the construction measures and with a mutual relation or dependence of the individual process steps to each other.

The dependencies between individual process steps can be specified by the respective exit rules, i.e. the transitional conditions. Each individual process step has one or several assigned transitional conditions for one or several different subsequent process steps. This does not require any global conditions but only conditions relating to a previous state. The transitional conditions result from parameter values that are recorded by the sensors when a construction measure is carried out. In this way, especially findings, questions or problems that arise only at a later point in time after the execution of a construction measure can be taken into consideration without difficulty when analyzing the amount of data.

A preferred embodiment of the invention resides in the fact that for the construction measure carried out a sequence of detected process steps is saved. The saving of detected process steps can take place at the same time as the construction measure is being carried out or subsequent thereto. Depending on a desired objective of an evaluation the exit rules with transitional conditions can be modified between the individual process steps so that according to the desired objective of the evaluation different sequences of process steps can be detected and saved.

According to a further preferred embodiment variant of the invention provision is made in that process steps are assigned a point in time, at which the characteristic parameter value for the detected process step was recorded. This point in time can represent both an end time for a process step and a starting time for a subsequent process step. The characteristic parameter value or the transitional condition can also be a combination of parameter values of different sensors.

Basically, firmly prescribed exit rules with defined transitional conditions can be provided. According to a further development of the invention it is particularly advantageous that defined process steps and/or associated exit rules are freely definable and modifiable at any point in time.

According to a further embodiment variant of the invention it is particularly expedient that each individual process step detected is assigned a starting time. By determining the duration of a process step it is thus possible, depending on the assignment of the process steps, to ascertain proportions of main times and non-productive times during operation of a construction machine and when a construction measure is carried out.

Another expedient method variant of the invention resides in the fact that detection and assignment of the defined process steps are carried out in the computer unit of the construction device or in a separate computer.

In conjunction with this it is particularly expedient that detection and assignment of the defined process steps are carried out during the construction measure or afterwards. This allows a great degree of freedom in data evaluation.

Basically, the method according to the invention can be implemented on any construction device for carrying out construction measures. The construction device can relate to a foundation engineering machine, such as a diaphragm wall grab, a diaphragm wall cutter, a vibrator or a pile driver for driving piles into the ground. According to an embodiment variant of the invention it is especially preferred that the construction device comprises a drilling apparatus for earth or rock drilling, wherein at least sinking, drilling, retraction and repositioning are provided as defined process steps. For instance when a drilling tool is sunk into the ground different process steps can follow alternatively, as for example a process step of drilling, a step of suspension feeding or a process step of hold. A transition to a process step of drilling can be established in that a corresponding sensor value of the drill drive is recorded. With regard to the step of suspension feeding a corresponding sensor value of a pump can be recorded that indicates a start of operation of a concrete or suspension pump for example. The pump can be part of the drilling apparatus itself or provided separate from the drilling apparatus as a further component of the construction device. Hence, a construction device according to the invention can be formed of several machines or apparatuses or of a machine having components separate therefrom.

By way of the method according to the invention almost any evaluation of an amount of data recorded in construction operation can take place. Due to the dynamic design of exit rules construction measures can be flexibly divided into different process steps and process step sequences and analyzed in a correspondingly target-oriented way. For instance, if problems or an increased degree of wear have occurred on a construction machine when a construction measure is carried out, a process step relating to a possible cause can be specifically defined and the data recorded during the construction measure can be retroactively examined and analyzed with regard to the process step thus defined. In this way, possible sources of error can be specifically examined and resultant adverse effects occurring on a construction machine or a construction tool can be remedied efficiently.

According to a further development of the invention it is especially advantageous that based on the detected process steps an evaluation concerning the operation of the construction device takes place, in particular an ascertainment of economic efficiency. A duration of the individual process steps can be recorded. Thus, a targeted analysis of main times and non-productive times as well as downtimes of the construction device during the execution of a construction measure can be carried out.

The invention furthermore comprises a construction device, in particular a foundation engineering machine, which is characterized in that the construction device is designed with a computer unit for carrying out the previously described method. The advantages described beforehand can be achieved thereby.

Basically, the construction device can be any construction device for carrying out construction measures. According to a further development of the invention it is particularly preferred that this is designed as a drilling apparatus, a diaphragm wall cutter, a diaphragm wall grab, a vibrator or a pile driver. This allows foundation engineering measures to be carried out in particular. The construction device can additionally have components separate therefrom, such as suspension pumps, desanding plants, concrete mixing plants and the like.

The invention claimed is:

1. A method for carrying out a construction measure for foundations with a construction device which has a plurality of actuation elements, sensors for recording operating states relating to the actuation elements, and a computer unit by which recorded parameter values of the sensors are received when carrying out the construction measure, wherein for the construction measure a number of different defined process steps are stored in a dynamic list of process steps, wherein one or more of the defined process steps has several assigned transitional conditions for several different alternative subsequent defined process steps, such that the dynamic list of process steps is changeable by the computer unit during carrying out of the construction measure, wherein from one defined process step to at least one alternative subsequent defined process step a transition takes place as a result of at least one exit rule, wherein to each exit rule at least one characteristic parameter value of at least one sensor is assigned, and wherein the recorded parameter values of the sensors are compared to the exit rules and a transition from an associated defined process step to a subsequent alternative defined process step is detected responsive to the comparisons of the recorded parameter values with the exit rules.

2. The method according to claim 1, wherein for the construction measure carried out a sequence of detected process steps is saved.

3. The method according to claim 1, wherein the defined process steps are assigned a point in time at which the characteristic parameter value for a detected process step was recorded.

4. The method according to claim 1,
wherein
the defined process steps and/or associated exit rules are freely definable and modifiable at any point in time.

5. The method according to claim 1,
wherein
each defined process step detected is assigned a starting time.

6. The method according to claim 1,
wherein
detection and assignment of the defined process steps are carried out in the computer unit of the construction device or in a separate computer.

7. The method according to claim 6,
wherein
detection and assignment of the defined process steps are carried out during the construction measure or afterwards.

8. The method according to claim 1,
wherein
the construction device comprises a drilling apparatus for earth or rock drilling, wherein at least sinking, drilling, retraction and repositioning are provided as defined process steps.

9. The method according to claim 1,
wherein
based on the detected process steps an evaluation concerning the operation of the construction device takes place, including an ascertainment of economic efficiency.

10. A construction device for foundations, the construction device having a plurality of actuation elements, sensors for recording operating states relating to the actuation elements, and a computer unit for receiving values recorded by the sensors on the operating states, wherein the computer unit is for storing, for a construction measure for foundations, a number of different defined process steps in a dynamic list of process steps, one or more of the defined process steps having several assigned transitional conditions for several different alternative subsequent defined process steps, such that the dynamic list of process steps is changeable by the computer unit during carrying out of the construction measure, the computer unit is for storing a plurality of exit rules, wherein from one defined process step to at least one alternative subsequent defined process step a transition takes place as a result of at least one of the exit rules, and to each of the exit rules at least one characteristic parameter value of at least one sensor is assigned, and the computer unit is for comparing the recorded parameter values of the sensors to the exit rules and detecting a transition from an associated defined process step to a subsequent alternative defined process step responsive to the comparisons of the recorded parameter values with the exit rules.

11. The construction device according to claim 10, comprising a drilling apparatus, a diaphragm wall cutter, a vibrator or a pile driver.

* * * * *